US009102051B2

(12) United States Patent
Chen

(10) Patent No.: US 9,102,051 B2
(45) Date of Patent: Aug. 11, 2015

(54) RETRACTABLE ROD STRUCTURE OF HAND TOOL

(71) Applicant: Chia-Yu Chen, Taichung (TW)

(72) Inventor: Chia-Yu Chen, Taichung (TW)

( * ) Notice: Subject to any disclaimer, the term of this patent is extended or adjusted under 35 U.S.C. 154(b) by 263 days.

(21) Appl. No.: 13/946,914

(22) Filed: Jul. 19, 2013

(65) Prior Publication Data

US 2015/0020653 A1 Jan. 22, 2015

(51) Int. Cl.
*B25G 1/04* (2006.01)

(52) U.S. Cl.
CPC ..... *B25G 1/04* (2013.01)

(58) Field of Classification Search
CPC ..... B25G 1/04; B25G 1/043; B25G 1/046
See application file for complete search history.

(56) References Cited

U.S. PATENT DOCUMENTS 4,662,771 A * 5/1987 Roe et al. ..... 403/108
4,922,577 A * 5/1990 Unger ..... 16/429
5,502,864 A * 4/1996 Sorenson ..... 15/230.11
5,598,598 A * 2/1997 Sorenson ..... 15/144.4
5,692,856 A * 12/1997 Newman et al. ..... 403/352
5,694,695 A * 12/1997 Lund ..... 30/296.1
6,254,305 B1 * 7/2001 Taylor ..... 403/378
7,549,195 B2 * 6/2009 Bensussan et al. ..... 16/429
2005/0279520 A1 * 12/2005 Newman et al. ..... 174/48
2007/0240545 A1 * 10/2007 Lin ..... 81/177.2
2009/0235512 A1 * 9/2009 Bensussan et al. ..... 29/525
2010/0215428 A1 * 8/2010 Trice ..... 403/359.5
2012/0155950 A1 * 6/2012 Donohue ..... 403/104
2013/0081231 A1 * 4/2013 Huang ..... 16/429
2013/0228051 A1 * 9/2013 Huang ..... 81/177.2
2014/0020848 A1 * 1/2014 White et al. ..... 157/1.3
2015/0015012 A1 * 1/2015 Coleman ..... 294/175

* cited by examiner

*Primary Examiner* — David B Thomas
(74) *Attorney, Agent, or Firm* — Wang Law Firm, Inc.; Li K. Wang; Stephen Hsu

(57) ABSTRACT

A retractable rod structure of a hand tool includes an inner rod disposed along an axis. One end of the inner rod is provided with a tightening seat. The tightening seat has a tightening surface on a circumferential side thereof. A tightening ring is fitted on the tightening surface. An outer rod is fitted on the inner rod. The outer wall of the tightening ring is against the inner wall of the outer rod. The outer rod is turned to bring the tightening ring to turn simultaneously. Through the guide of the tightening surface, the tightening ring is tightened between the tightening surface and the inner wall of the outer rod, like a wedge, such that the outer rod and the inner rod can be positioned at any desired position to adjust the length of the retractable rod structure of the hand stool in a stepless way.

8 Claims, 6 Drawing Sheets

RETRACTABLE ROD STRUCTURE OF HAND TOOL

BACKGROUND OF THE INVENTION

1. Field of the Invention

The present invention relates to a retractable rod structure of a hand tool. In particular, the length of the retractable rod structure can be adjusted in a stepless way.

2. Description of the Prior Art

During operation of a hand tool, the user has to extend the handle of the hand tool when the space is not enough to operate the hand tool. Sometimes, it is not convenient to carry or operate the hand tool because the handle of the hand tool is too long. Therefore, a retractable rod for a hand tool is developed. The retractable rod has an inner rod. The circumferential side of the inner rod has a coupling hole. An elastic button is provided in the coupling hole. An outer rod is fitted on the inner rod. The outer rod has a plurality of spaced holes which are arranged axially. Thus, the outer rod can slide axially relative to the inner rod for the elastic button to be engaged in a corresponding hole so as to adjust the length of the retractable rod.

However, the outer rod of the aforesaid retractable rod is only secured at the position where the holes are disposed to form a step-type adjustment. It cannot be adjusted for the best length according to the demand of the user. The holes of the outer rod will destroy the appearance of the retractable rod. Accordingly, the inventor of the present invention has devoted himself based on his many years of practical experiences to solve these problems.

SUMMARY OF THE INVENTION

The primary object of the present invention is to provide a retractable rod structure of a hand tool. The retractable rod structure can be adjusted in a stepless way and has a more beautiful appearance.

In order to achieve the aforesaid object, the retractable rod structure comprises an inner rod, a tightening seat, a tightening ring and an outer rod. The inner rod is disposed along an axis and has a coupling end. The tightening seat is disposed in the coupling end of the inner rod. The tightening seat has a tightening surface on a circumferential side thereof around the axis. The tightening surface has a beginning point and a terminal point. The distance between the tightening surface and the axis increases from the beginning point to the terminal point in a first direction around the axis. The tightening ring is fitted on the tightening surface and rotatable relative to the tightening surface. The tightening ring has a C shape. The tightening ring has a thin end and a thick end. The thickness of the tightening ring increases from the thin end to the thick end in a second direction opposite to the first direction around the axis. The outer rod is hollow and fitted on the inner rod along the axis. The outer wall of the tightening ring is against the inner wall of the outer rod.

Because the distance D between the tightening surface and the axis increases from the beginning point to the terminal point in the first direction around the axis as well as the thickness of the tightening ring increases from the thin end to the thick end in the second direction opposite to the first direction around the axis, the outer rod will bring the tightening ring to turn in the first direction when the user turns the outer rod in the first direction. The tightening ring will be tightened between the tightening surface and the inner wall of the outer rod, like a wedge, such that the outer rod cannot slide relative to the inner rod along the axis. Thus, the outer rod and the inner rod can be positioned at any desired position to adjust the length of the retractable rod structure of the hand stool in a stepless way. Because the tightening seat and the tightening ring are disposed inside the inner rod and the outer rod, the appearance of the retractable rod structure of the hand stool is pleasing to the eye.

DETAILED DESCRIPTION OF THE PREFERRED EMBODIMENTS

Embodiments of the present invention will now be described, by way of example only, with reference to the accompanying drawings.

Figure 1:
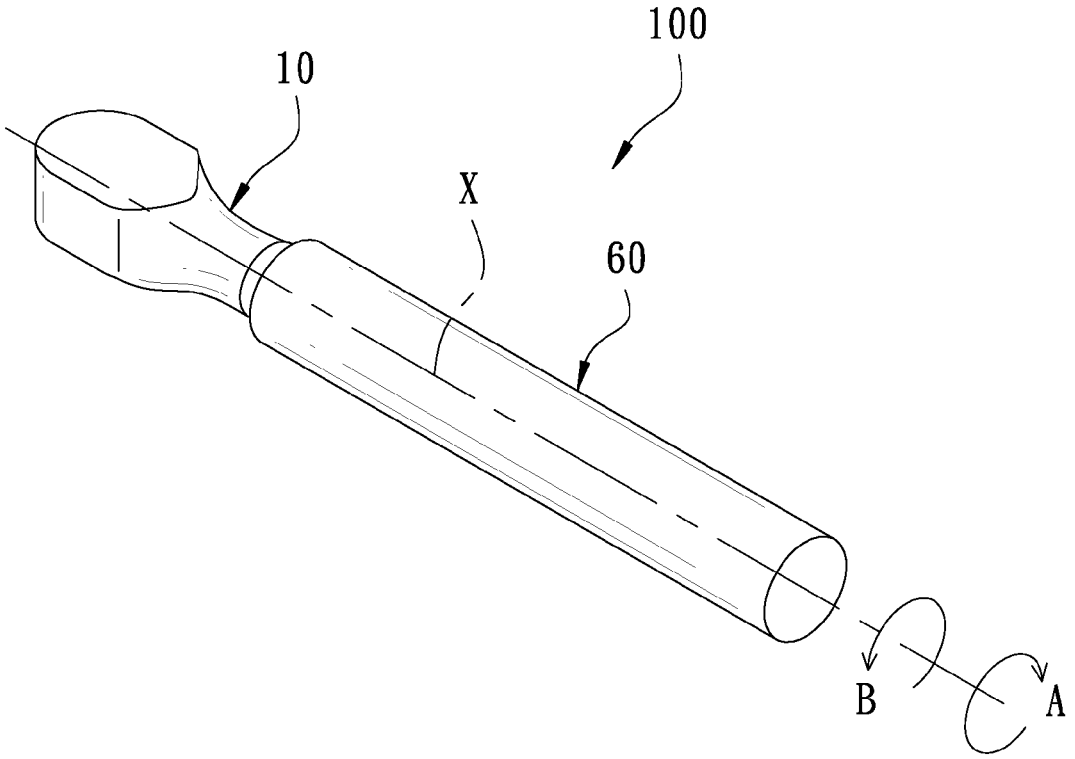
FIG. 1 is a perspective view according to a first embodiment of the present invention.
Figure 2:
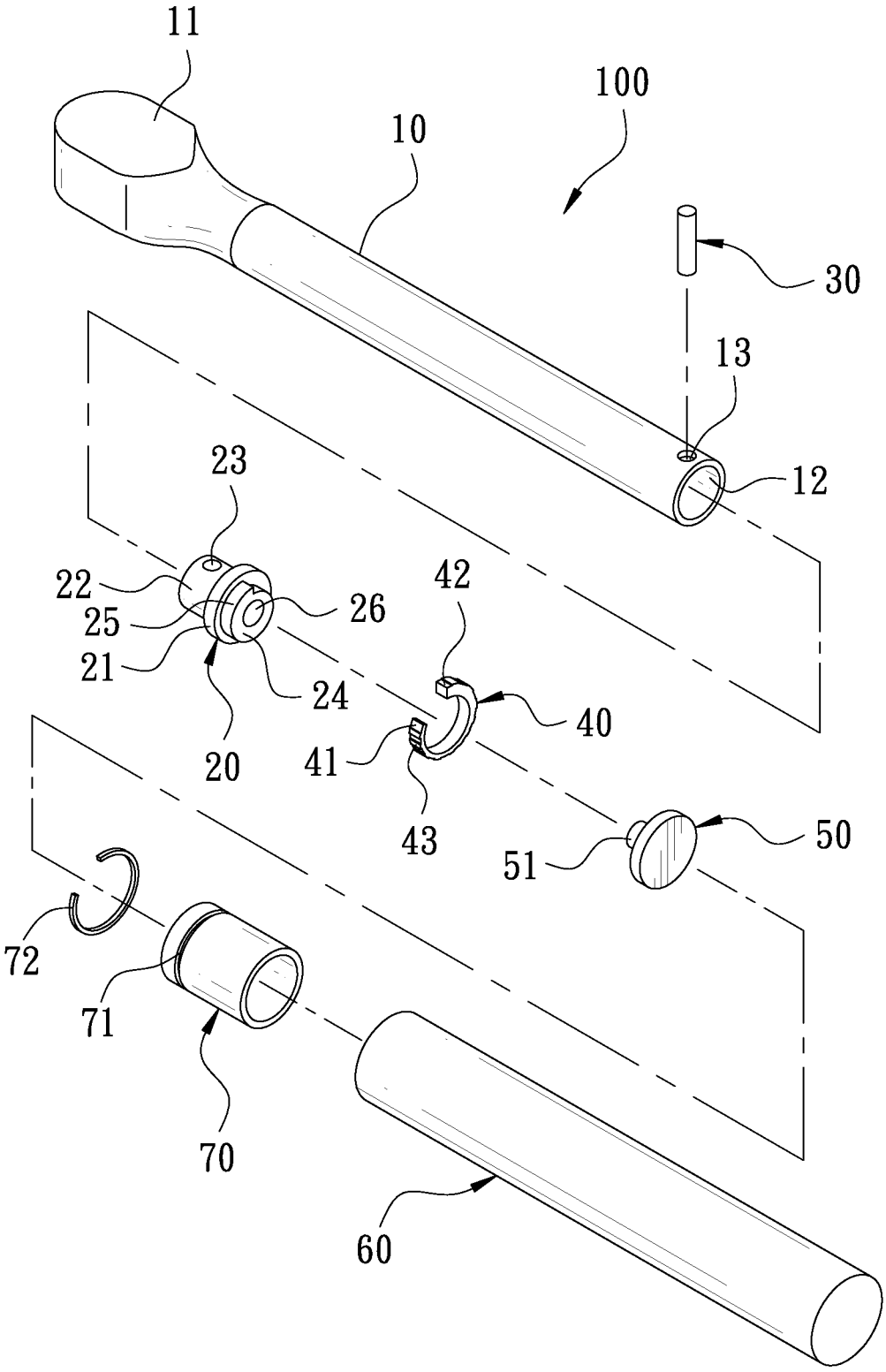
FIG. 2 is an exploded view according to the first embodiment of the present invention.
Figure 3:
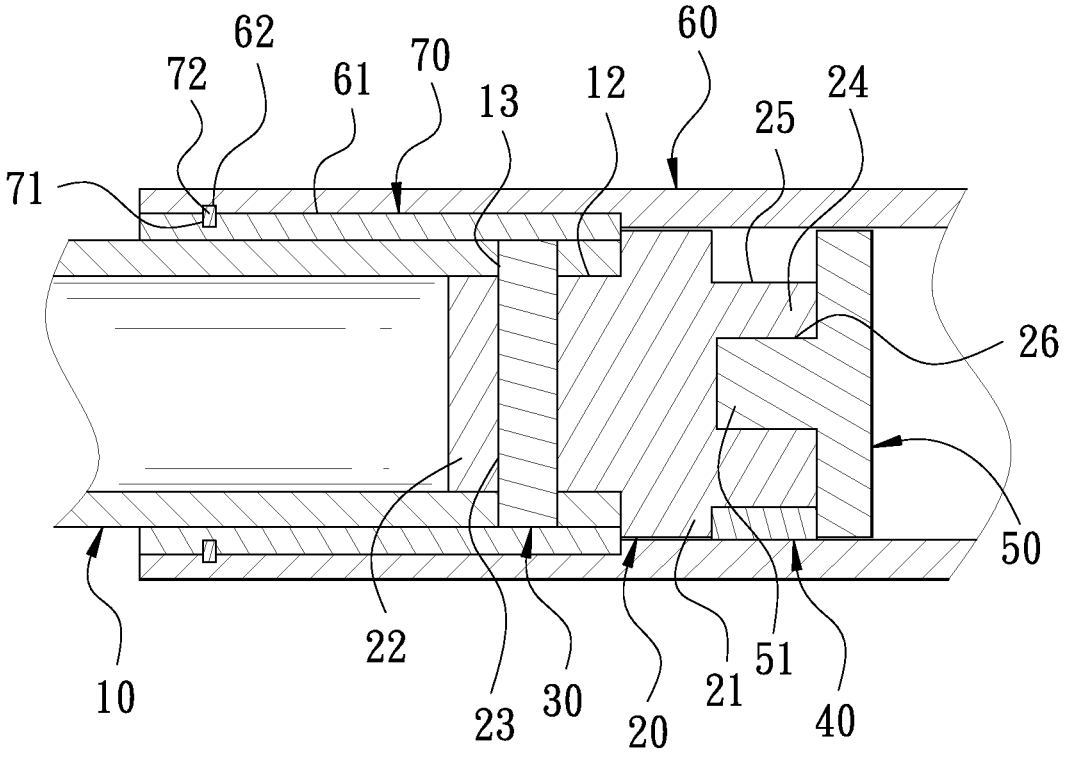
FIG. 3 is an axial sectional view according to the first embodiment of the present invention.
Figure 4:
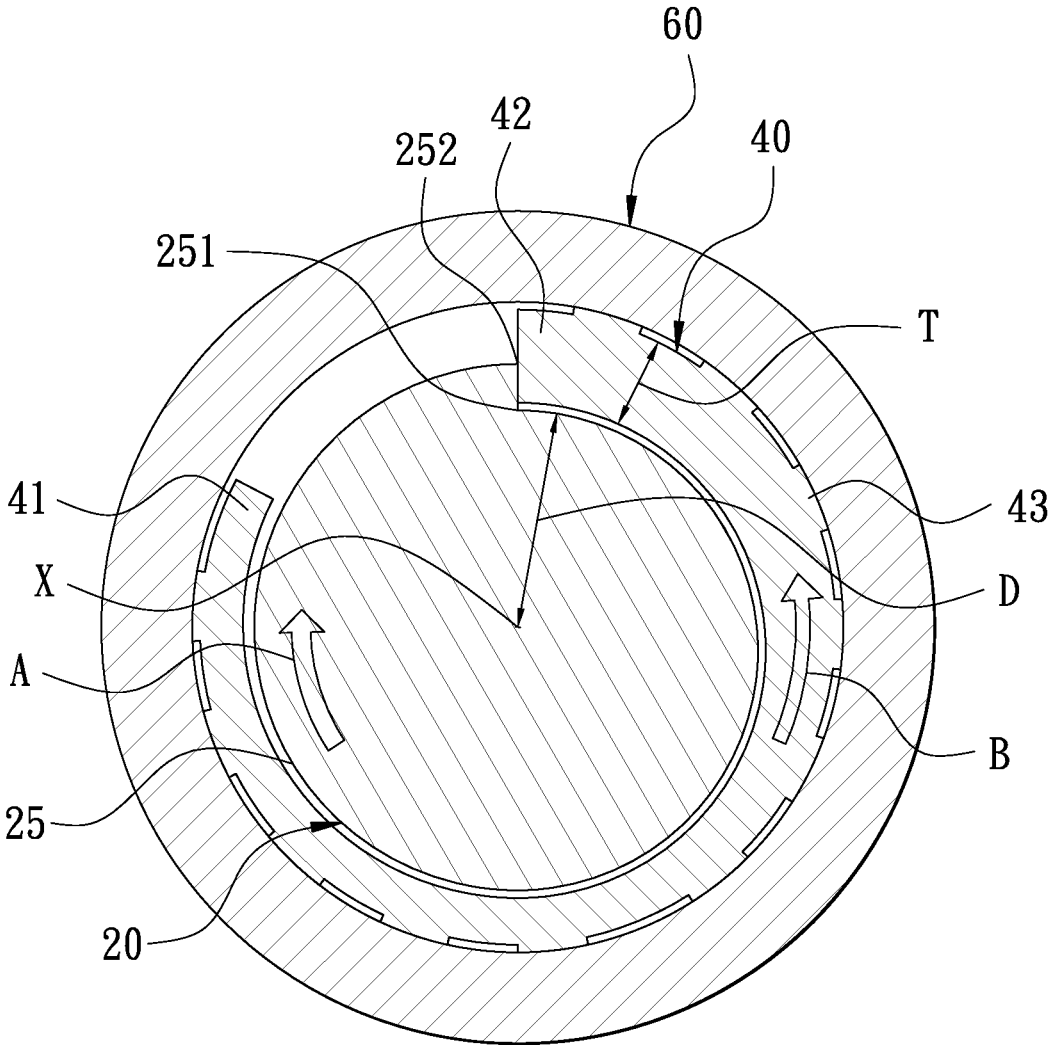
FIG. 4 is a radial sectional view according to the first embodiment of the present invention.

FIG. 1 is a perspective view according to a first embodiment of the present invention. FIG. 2 is an exploded view according to the first embodiment of the present invention. FIG. 3 is an axial sectional view according to the first embodiment of the present invention. FIG. 4 is a radial sectional view according to the first embodiment of the present invention. The present invention discloses a retractable rod structure 100 of a hand tool. The retractable rod structure 100 comprises an inner rod 10, a fastening seat 20, a tightening ring 40, a limit cover 50, an outer rod 60, and a limit ring 70.

The inner rod 10 is hollow and disposed along an axis X. The inner rod 10 has a head 11 at one end thereof and a coupling end 12 at another end thereof. The inner rod 10 further has a coupling hole 13 at a circumferential side thereof in proximity to the coupling end 12.

The tightening seat 20 is hollow and has a stop portion 21. The tightening seat 20 comprises a coupling portion 22 protruding from one side of the stop portion 22. The coupling portion 22 is coupled to the coupling end 12 of the inner rod 10. In this embodiment, the coupling portion 22 has a through hole 23 corresponding to the coupling hole 13 for a pin 30 to insert in the coupling hole 13 and the through hole 23 so that the tightening seat 20 is inserted and secured to the coupling end 12 of the inner end 10. The tightening seat 20 further comprises a protruding portion 24 protruding from another side of the stop portion 22. The protruding portion 24 has a tightening surface 25 on a circumferential side thereof around the axis X. Referring to FIG. 4, the tightening surface 25 has a beginning point 251 and a terminal point 252. The distance D between the tightening surface 25 and the axis X increases from the beginning point 251 to the terminal point 252 in a first direction A around the axis X. The protruding portion 24 has a fixing hole 26 at a distal end thereof.

The tightening ring 40 is fitted on the tightening surface 25 and rotatable relative to the tightening surface 25. Referring to FIG. 4, the tightening ring 40 has a shape. The tightening ring 40 has a thin end 41 and a thick end 42. The thickness T of the tightening ring 40 increases from the thin end 41 to the thick end 42 in a second direction B opposite to the first direction A around the axis X. The tightening ring 40 has a plurality of spaced protrusions 43 on an outer wall thereof.

The limit cover 50 has a fixing post 51 corresponding to the fixing hole 26. The fixing post 51 is inserted and secured in the fixing hole 26, so that the limit cover 50 is fixed to the distal end of the protruding portion 24 and cooperates with the stop portion 21 to limit the tightening ring 40 on the tightening surface 25.

The outer rod 60 is hollow and fitted on the inner rod 10 along the axis X, such that the outer wall of the tightening ring 40 is against the inner wall of the outer rod 60. The outer rod 60 has a limit trough 61 at one end thereof and a first engaging groove 62 on the circumferential wall of the limit trough 61.

The limit ring 70 is disposed in the outer rod 60 and located between the head 11 of the inner rod 10 and the stop portion 21 of the tightening seat 20. In this embodiment, the outer wall of the limit ring 70 has a second engaging groove 71 corresponding to the first engaging groove 62. A C-shaped ring 72 is engaged in the first engaging groove 62 and the second engaging groove 71 to secure the limit ring 70 in the limit trough 61.

Figure 5:
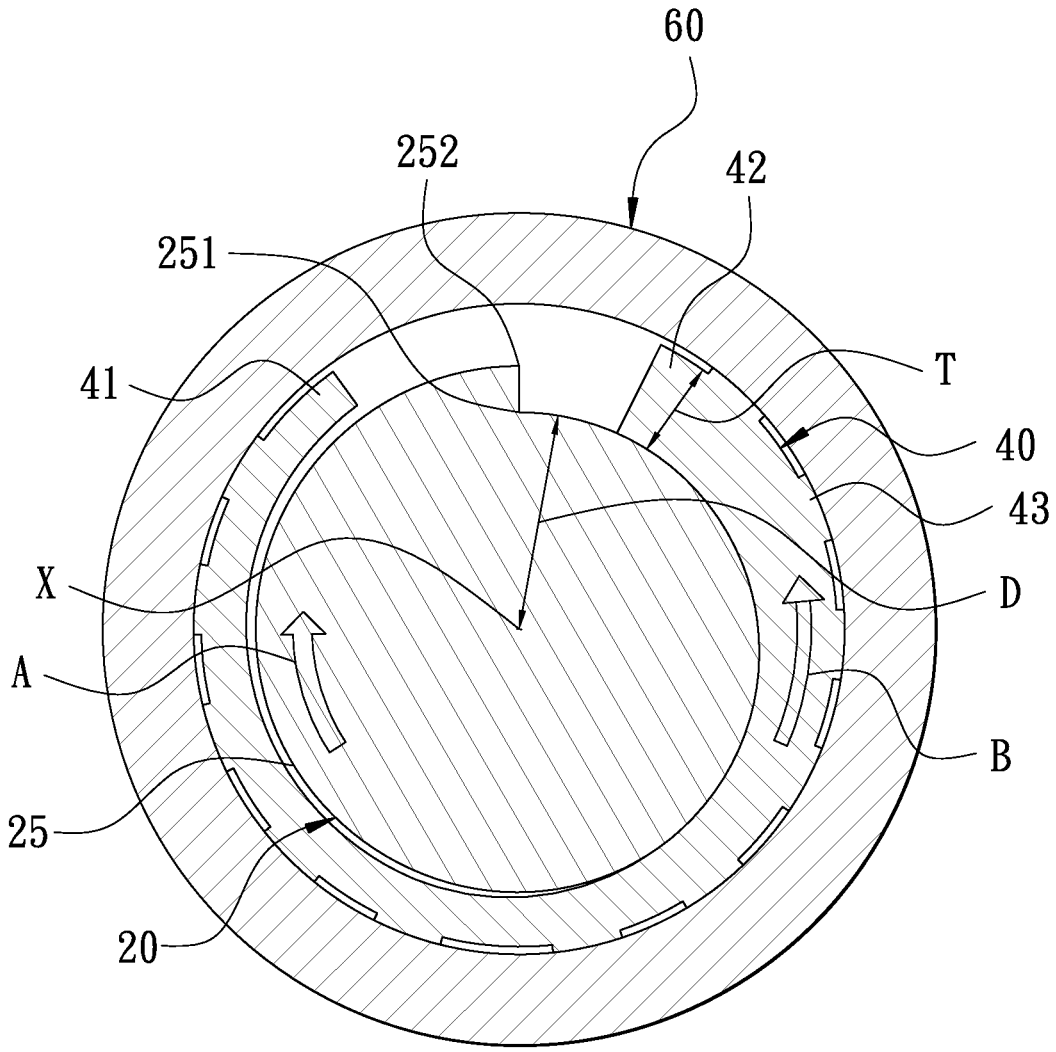
FIG. 5 is a schematic view showing operation of the first embodiment of the present invention.

FIG. 5 is a schematic view showing operation of the first embodiment of the present invention. Because the distance D between the tightening surface 25 and the axis X increases from the beginning point 251 to the terminal point 252 in the first direction A around the axis X as well as the thickness T of the tightening ring 40 increases from the thin end 41 to the thick end 42 in the second direction B opposite to the first direction A around the axis X, the outer rod 60 will bring the tightening ring 40 to turn in the first direction A when the user turns the outer rod 60 in the first direction. The tightening ring 40 will be tightened between the tightening surface 25 and the inner wall of the outer rod 60, like a wedge, such that the outer rod 60 cannot slide relative to the inner rod 10 along the axis X. Thus, the outer rod 60 and the inner rod 10 can be positioned at any desired position to adjust the length of the retractable rod structure 100 of the hand stool in a stepless way.

When the user wants to adjust the length of the retractable rod structure 100 of the hand stool again, he/she turns the outer rod 60 in the second direction B. The outer rod 60 brings the tightening ring 40 to turn in the second direction B, as shown in FIG. 4, to form a gap between the tightening ring 40 and the tightening surface 25. The tightening ring 40 can be slightly compressed inwardly, so that the outer rod 60 can slide relative to the inner rod 10 along the axis X. Thus, the length of the retractable rod structure 100 of the hand stool can be adjusted.

It is noted that the protrusions 43 on the outer wall of the tightening ring 40 can increase friction when the outer rod 60 is turned, such that the outer rod 60 can grab the tightening ring 40 effectively to bring the tightening ring 40 to turn. Because the tightening seat 20 and the tightening ring 40 are disposed inside the inner rod 10 and the outer rod 60, the appearance of the retractable rod structure 100 of the hand stool is pleasing to the eye.

Figure 6:
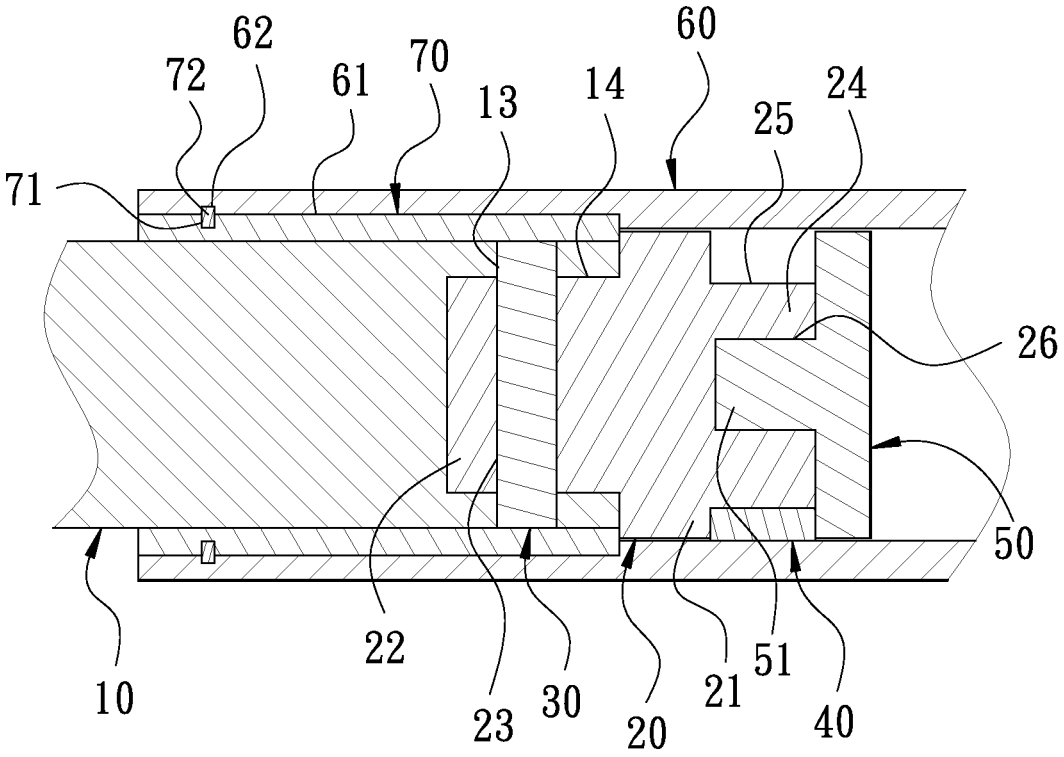
FIG. 6 is an axial sectional view according to a second embodiment of the present invention.

FIG. 6 is an axial sectional view according to a second embodiment of the present invention. In the second embodiment, the retractable rod structure 100 of the hand stool is substantially similar to the first embodiment with the exceptions described hereinafter. The inner rod 10 is solid. The coupling end 12 of the inner rod 10 has a coupling trough 14. The circumferential side of the inner rod 10 has a coupling hole 13 which communicates with the coupling trough 14. The coupling portion 22 of the tightening seat 20 is inserted in the coupling trough 14. The tightening seat 20 has a through hole 23 corresponding to the coupling hole 13 for the pin 30 to insert in the coupling hole 13 and the through hole 23 so that the tightening seat 20 is secured to the coupling trough 14 to achieve the same effects like the first embodiment. The retractable rod has a pleasing appearance and the length can be adjusted in a stepless way.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A retractable rod structure of a hand tool, comprising:

an inner rod disposed along an axis and having a coupling end;

a tightening seat disposed in the coupling end of the inner rod, the tightening seat having a tightening surface on a circumferential side thereof around the axis, the tightening surface having a beginning point and a terminal point, a distance between the tightening surface and the axis increasing from the beginning point to the terminal point in a first direction around the axis;

a tightening ring fitted on the tightening surface and rotatable relative to the tightening surface, the tightening ring having a C shape, the tightening ring having a thin end and a thick end, a thickness of the tightening ring increasing from the thin end to the thick end in a second direction opposite to the first direction around the axis; and an outer rod being hollow and fitted on the inner rod along the axis, an outer wall of the tightening ring being against an inner wall of the outer rod.

2. The retractable rod structure of a hand tool as claimed in claim 1, wherein the tightening seat has a stop portion and a coupling portion protruding from one side of the stop portion, the coupling portion being coupled to the coupling end of the inner rod, the tightening seat further having a protruding portion protruding from another side of the stop portion, the protruding portion having the tightening surface on a circumferential side thereof around the axis.

3. The retractable rod structure of a hand tool as claimed in claim 2, wherein the protruding portion has a fixing hole at a distal end thereof, the retractable rod structure further comprising a limit cover, the limit cover having a fixing post corresponding to the fixing hole, the fixing post being inserted and secured in the fixing hole so that the limit cover is fixed to the distal end of the protruding portion and cooperates with the stop portion to limit the tightening ring on the tightening surface.

4. The retractable rod structure of a hand tool as claimed in claim 2, wherein the inner rod has a head at one end thereof and the coupling end at another end thereof, the retractable rod structure further comprising a limit ring, the limit ring being disposed in the outer rod and located between the head of the inner rod and the stop portion of the tightening seat.

5. The retractable rod structure of a hand tool as claimed in claim 4, wherein the outer rod has a limit trough at one end thereof and a first engaging groove on a circumferential wall of the limit trough, an outer wall of the limit ring having a second engaging groove corresponding to the first engaging groove, a C-shaped ring being engaged in the first engaging groove and the second engaging groove to secure the limit ring in the limit trough.

6. The retractable rod structure of a hand tool as claimed in claim 1, wherein the tightening ring has a plurality of spaced protrusions on an outer wall thereof.

7. The retractable rod structure of a hand tool as claimed in claim 1, wherein the inner rod is hollow, the inner rod having a coupling hole at a circumferential side thereof in proximity to the coupling end, the tightening seat being inserted in the coupling end of the inner rod, the tightening seat having a through hole corresponding to the coupling hole for a pin to insert in the coupling hole and the through hole so that the tightening seat is secured to the coupling end of the inner end.

8. The retractable rod structure of a hand tool as claimed in claim 1, wherein the inner rod is solid, the coupling end of the inner rod having a coupling trough, a circumferential side of the inner rod having a coupling hole which communicates with the coupling trough, the tightening seat being inserted in the coupling trough, the tightening seat having a through hole corresponding to the coupling hole for a pin to insert in the coupling hole and the through hole so that the tightening seat is secured to the coupling end of the inner rod.

* * * * *